US006214165B1

(12) United States Patent
Kundrot

(10) Patent No.: US 6,214,165 B1
(45) Date of Patent: Apr. 10, 2001

(54) METHOD FOR DEACIDIFICATION OF PAPERS AND BOOKS BY FLUIDIZING A BED OF DRY ALKALINE PARTICLES

(75) Inventor: Robert A. Kundrot, Springfield, OR (US)

(73) Assignees: Joseph Zicherman, Berkeley; Donald Perkins, Loomis, both of CA (US)

( * ) Notice: Subject to any disclaimer, the term of this patent is extended or adjusted under 35 U.S.C. 154(b) by 0 days.

(21) Appl. No.: 09/352,375

(22) Filed: Jul. 13, 1999

(51) Int. Cl.[7] ..... D21H 25/18

(52) U.S. Cl. ..... 162/57; 162/160; 162/192; 422/40; 427/180; 427/182

(58) Field of Search ..... 162/160, 90, 57, 162/50, 192; 422/40; 427/180, 182

(56) References Cited

U.S. PATENT DOCUMENTS

| | | | |
|---|---|---|---|
| 2,033,452 | 3/1936 | Schierholtz | 162/160 |
| 2,864,723 | 12/1958 | Fluck et al. | 427/38.9 |
| 3,472,611 | 10/1969 | Langwell | 21/58 |
| 3,665,041 | 5/1972 | Sianesi et al. | 260/615 A |
| 3,676,055 | 7/1972 | Smith | 8/120 |
| 3,676,182 | 7/1972 | Smith | 117/60 |
| 3,703,353 | 11/1972 | Kusterer et al. . | |
| 3,771,958 | 11/1973 | Kusterer, Jr. et al. | 21/58 |
| 3,810,874 | 5/1974 | Mitsch et al. . | |
| 3,837,804 | 9/1974 | Walker et al. | 21/58 |
| 3,898,356 | 8/1975 | Williams et al. | 427/343 |
| 3,939,091 | 2/1976 | Kelly, Jr. | 252/189 |
| 3,969,549 | 7/1976 | Williams et al. | 427/248 |
| 4,051,276 | 9/1977 | Williams et al. | 427/248 C |
| 4,318,963 | 3/1982 | Smith | 428/537 |
| 4,522,843 | 6/1985 | Kundrot | 427/27 |
| 4,860,685 | 8/1989 | Smith | 118/300 |
| 4,863,566 | 9/1989 | Warren et al. | 162/160 |
| 4,927,497 | 5/1990 | Sharpe | 162/160 |
| 5,094,888 | 3/1992 | Kamienski et al. | 427/296 |
| 5,104,997 | 4/1992 | Kamienski et al. | 556/130 |
| 5,208,072 | 5/1993 | Kamienski et al. | 427/296 |
| 5,219,524 | 6/1993 | Evans, II | 422/40 |
| 5,264,243 | 11/1993 | Wedinger et al. | 427/140 |
| 5,277,842 | 1/1994 | Wittekind et al. | 252/400.31 |
| 5,282,320 | 2/1994 | Wedinger et al. | 34/12 |
| 5,322,558 | 6/1994 | Wiltekind et al. | 106/257.24 |
| 5,393,562 | 2/1995 | Sebera | 427/248.1 |
| 5,409,736 | 4/1995 | Leiner et al. | 427/372.2 |
| 5,422,147 * | 6/1995 | Leiner et al. | 162/160 |
| 5,433,827 | 7/1995 | Page et al. | 162/160 |
| 5,770,148 * | 6/1998 | Leiner et al. | 422/40 |

OTHER PUBLICATIONS

Porck, H.J., "Mass Deacidification—An update of posibilities and limitations", ISBN 90–6984–162–2.

* cited by examiner

*Primary Examiner*—Steve Alvo
(74) *Attorney, Agent, or Firm*—Dergosits & Noah LLP

(57) ABSTRACT

Lignocellulosic materials such as paper are deacidified by exposure to acoustically agitated submicron alkaline particles which adhere to the materials being treated. The alkaline particles neutralize the acidity of the paper and counteract the effects of acid degradation. The alkaline deacidification process does not employ volatile compounds or liquids and does not damage the paper.

19 Claims, 4 Drawing Sheets

METHOD FOR DEACIDIFICATION OF PAPERS AND BOOKS BY FLUIDIZING A BED OF DRY ALKALINE PARTICLES

FIELD OF INVENTION

The present invention describes a cost effective means to the deacidification of cellulose based materials.

BACKGROUND OF THE INVENTION

Materials made of lignocellulosics such as paper are subject to a number of chemical, physical and biological hazards. Many chemical pulping, mechanical pulping, bleaching and sizing processes used in the last 200 years produce paper that has an inherent acidity that limits storage stability. Paper based materials are slowly deteriorating due to oxidative acid hydrolysis caused by both the acidity induced during manufacturing and further exposure to acidic air pollutants such as the oxides of sulfur and nitrogen and direct contact with acid containing materials, e.g. acidic paper and books.

The deterioration of paper and other lignocellulosic materials due to oxidative acid hydrolysis is widespread and losses to library and archival collections are estimated to be as high as one percent per year. Many manuscripts and books have become so embrittled that they are too fragile for normal use and must be removed from general circulation. The content of important books and papers is being microfilmed or digitized, but this only creates recordings of information. Stabilization of these works against acidity is necessary to preserve the original materials.

Deacidification or neutralization of the acids in paper is a known method of reducing the effects of oxidative acid hydrolysis. It is also well known to people skilled in the art that the deposition of an alkaline reserve into paper is also necessary to continue the protection of paper from the effects of acid degradation, U.S. Pat. Nos. 2,033,452 and 2,864,723. Earlier methods used soluble alkaline salts in polar solvents such as water. These methods could not be used on most materials due to damage caused by polar liquids. To circumvent these problems, most newer processes use either an alkaline gas or a soluble alkaline compounds in non-polar solvents to first neutralize acids present in paper then add an excess of the agent to provide an alkaline reserve into a material. One deacidification process treats paper by depositing insoluble small alkaline particles from a dispersion in an inert liquid. This provides not only an alkaline reserve, but also effectively stabilizes paper by providing alkalinity to neutralize acids in paper as they naturally diffuse through the paper.

A report titled "Mass Deacidification—An Update of Possibilities and Limitations" by H. J. Porck published in 1996, reviewed the leading methods of deacidification. The processes discussed in the Porck report include: the Diethyl Zinc, the Wei'To, the Bookkeeper, the Battelle, the FMC methods and an aerosol procedure in early development. The Diethyl Zinc method is gas based while all other deacidification methods reviewed in the Porck Report use alkaline compounds dissolved or suspended in liquids.

The Diethyl Zinc (DEZ) method disclosed in U.S. Pat. Nos. 3,969,549 and 4,051,276 utilizes a volatile metal alkyl, diethyl zinc. The DEZ process as described by Porck requires that paper be very dry so the material must be vacuum dried for 2–3 days before treatment. After drying, materials are exposed to gaseous diethyl zinc for 16–18 hours. Liquid diethyl zinc is pyrophoric and will ignite when exposed to air and reacts explosively with water.

Consequently, the DEZ process was abandoned for reasons of safety and complexity in 1994.

The Wei'To method is one of the first organic liquid-phase mass deacidification processes and utilizes methoxymagnesium methylcarbonate (MMC) dissolved in an alcohol (methanol) which is then dispersed in fluorocarbons (CFCs) or hydrofluorocarbons (HCFCs). The process is described in U.S. Pat. Nos. 4,318,963, 3,676,055, 3,676,182 and 3,939,091. After the MMC neutralizes the acidity, it reacts with residual water in the paper to form magnesium oxide. The magnesium oxide then slowly reacts with ambient air and carbon dioxide to form magnesium hydroxide and basic magnesium carbonate which remain in the paper to form an alkaline reserve.

There are several drawbacks to the Wei'To method. The alcohol solvent used to dissolve the MMC may cause certain types of sensitive inks and dyes in the paper to run or feather. Alcohols are also very difficult to remove completely from paper and may leave a residual odor in the treated materials. Another drawback is that the CFCs and HCFCs have been restricted from manufacture by government regulations due to their ozone depletion potential. The Wei'To method also requires that books be dried for up to 36 hours prior to treatment and then reconditioned for two or three days after treatment.

The Bookkeeper method is the only deacidification method that utilizes alkaline particles of a basic metal oxide suspended in inert liquids with a suitable surfactant. The process is disclosed in U.S. Pat. No. 4,522,843 using CFC's and later in U.S. Pat. No. 5,409,736 when CFC's were replaced with perfluorocarbons. The '843 patent also teaches the treatment of paper or lignocellulosic material by direct impingement with an aerosol containing submicron alkaline particles and the use of electrostatic forces or a vacuum to draw the alkaline particles towards the paper. The Bookkeeper process deposits particulate magnesium oxide in paper which slowly reacts with water and carbon dioxide to form magnesium hydroxide and basic magnesium carbonate which resist the acidification process.

Drawbacks of the Bookkeeper method include complex treatment processes. The materials are subject to vacuum prior to treatment. The perfluorocarbon liquids used are expensive and the recovery of the perfluorocarbons requires both heat and vacuum for up to 18 hours. The long vacuum/heat liquid recovery process further dries the treated paper and the residual surfactants may reduce the abrasion resistance of the paper.

The German National Library, Frankfurt/Leipzig (Die Deutsche Bibliothek) developed deacidification methods described in U. S. Pat. Nos. 5,277,842 and 5,322,558, which are known as the "Battelle" method. The Battelle method utilizes magnesium titanium ethoxide (MTE) dissolved in hexadimethyl disiloxane. The MTE neutralizes acids then reacts with residual water in the paper to first form magnesium oxide which slowly reacts with additional water and carbon dioxide to form magnesium hydroxide and basic magnesium carbonate which resists the acidification process.

There are several drawbacks to the Batelle deacidification process. Books treated with the Battelle process must be dried for about 2 days prior to treatment and reconditioned for 3 weeks to reduce the residual treatment odor. The Batelle process uses hexadimethyl disiloxane, an expensive and highly flammable material that requires the use of explosion proof storage and treatment facilities. Further, to speed drying and solvent recovery, the Battelle process uses microwave energy drying that may damage any paper or books containing metallic inks, staples or stitching.

The FMC deacidification process is disclosed in U. S. Pat. Nos. 5,104,997, 5,208,072 and 5,264,243. The FMC process utilizes magnesium butyl glycolate (MGB) dissolved in heptane and claims that MGB both strengthens and deacidifies the treated materials. As with the other liquid based methods, the MGB reacts with traces of water to form the alkaline compounds magnesium oxide, magnesium hydroxide and basic magnesium carbonate to form an alkaline reserve.

The FMC process employs dielectric or radio frequency drying of materials prior to treatment as disclosed in U.S. Pat. No. 5,282,320. A post processing radio frequency heating step is also used to recover the heptane solvent. As with microwave energy, radio frequency heating may damage books or paper containing any metallic material.

Other drawbacks of the FMC process include the reaction of MGB and heptane solvents with the common book materials which adversely affects the materials. Residual glycolate in the FMC treated paper may form humectant glycols which cause the paper to swell and attract water vapor which change the texture of the paper. Heptane is also a flammable solvent requiring special storage and handling procedures.

The aerosol treatment process discussed in the Porck report deacidifies books by impinging alkaline particles in a stable aerosol cloud of submicron particles onto the pages. In order to prevent agglomeration the concentration of alkaline particles must be less than about a few milligrams/cubic foot to maintain stability. It is calculated that approximately five to ten cubic feet of this low concentration alkaline aerosol with must impact upon or past through a sheet of paper to deposit the required quantity of alkaline reserve(3% $CaCO_3$). In addition, the deposition rate is very slow and the complex geometry of books makes it difficult to uniformly treat all pages of a book using aerosol impingement.

There are other deacidification processes disclosed in the literature. Almost all of these use gaseous deacidification agents. U.S. Pat. Nos. 3,472,611 and 4,927,497 disclose the use of volatile cyclohexylamine carbonate gas as a deacidification agent. U.S. Pat. Nos. 3,771,958 and 3,837,804 disclose the use of morpholine gas as a deacidification agent. U.S. Pat. Nos. 3,771,958 and 5,393,562 both disclose the use of ammonia gas as a deacidification agent. A problem with deacidification agents as a gas or vapor is that they do not remain in paper to provide the alkaline reserve required for long term protection from future acid attack. Further, many volatile amines leave residual odors in treated books and may pose health risks. Many gas based deacidification processes have been abandoned due to safety problems, high costs, residual odor and reports of damage to materials treated.

An alternate deacidification method to either gas or liquid treatments is disclosed in U.S. Pat. No. 5,433,827. The '827 patent process interlaces paper with sheets of base impregnated paper which allows mobile alkaline metal cations to neutralize acids in the paper. The books are then subjected to heat and pressure at a relatively high humidity over a number of days during which time alkaline metal cations migrate through the paper. This method is very labor intensive, can damage bindings and does not deposit an adequate alkaline reserve to prevent damage from future exposure to acids.

What is needed is a simple deacidification process that can treat books in a reasonable amount of time and prevent damage from future acid exposure without the use of hazardous materials.

SUMMARY OF THE INVENTION

According to the present invention, acidic cellulosic materials can be quickly infused with inexpensive non-toxic alkaline materials without the use of liquids. Cellulose-based books, papers and other materials can be protected from the effects of oxidative acid hydrolysis and preserved by treatment with submicron alkaline particles of basic metal oxides, hydroxides or salts. The alkaline particles are deposited on cellulosic materials increasing the pH of the materials and while providing an alkaline buffer.

To dramatically increase the concentration of alkaline particles over that found in a stable aerosol and break up agglomerates of submicron alkaline particles that tend to naturally form, the particle bed is agitated by acoustic energy having specific frequencies and amplitudes. The acoustic agitation also suspends the submicron alkaline particles in a fluidized bed, provides for constant agitation of the particles and results in more uniform particle penetration of the paper structure. Paper and other lignocellulosic materials may be immersed in a sonically energized bed of alkaline particles. The alkaline particles are deposited on the materials and neutralize acids in the paper. The cellulosic materials can be treated adequately in seconds rather than hours.

The acoustic agitation method can be used to deacidify bound materials by either immersing the materials in a bed of agitated particles or passing such materials through a zone containing an activated bed of alkaline particles. Book pages may be fanned open and exposed to alkaline particles by independent jets of air, allowing books to be deacidified within a few minutes. Alternatively, items can be deacidified by moving transducers over the pages in a traverse manner to agitate a zone of alkaline particles which impinge upon the paper.

The deacidification processing chamber may be configured with ultrasonically oscillating walls or plates which circulate the agitated submicron alkaline particles and allows treatment in ambient conditions in a manner which imparts little stress to the material. After treatment, the materials do not require lengthy post-conditioning periods. The inventive deacidification system is non-hazardous, designed for in-house operations and does not require specially trained operators.

BRIEF DESCRIPTION OF THE DRAWINGS

The invention is herein described, by way of example only, with reference to embodiments of the present invention illustrated in the accompanying drawings, wherein.

DETAILED DESCRIPTION OF THE INVENTION

Figure 1:
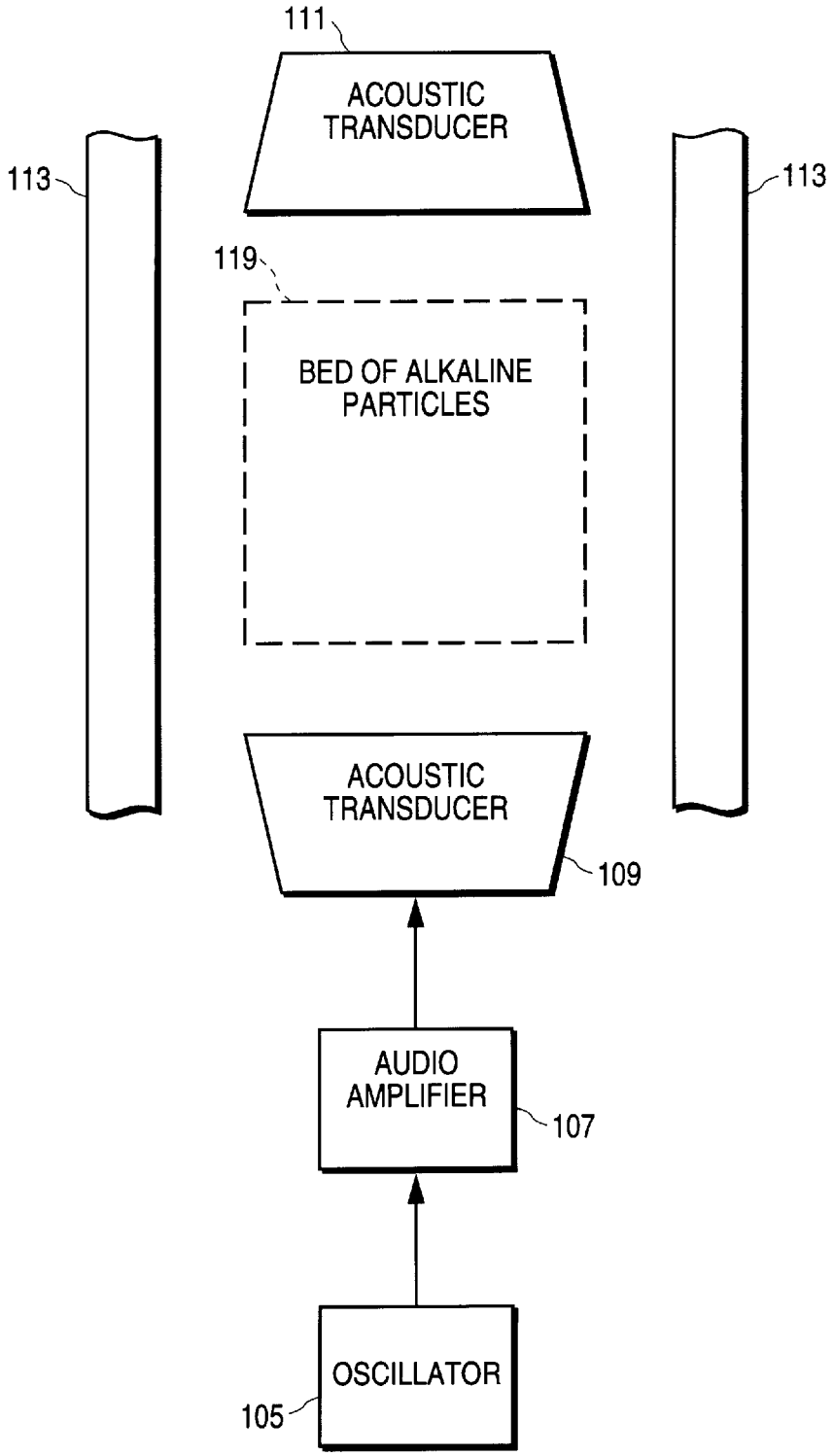
FIG. 1 illustrates a deacidification apparatus of the present invention.

The present invention deacidifies paper and books in a brief period of time with a stable aerosol having a high concentration of submicron alkaline particles. The present invention uses acoustic energy to fluidize submicron alkaline particles which penetrate the matrix of the materials being treated. Specifically, acoustic energy is directed at the alkaline particles which respond by vibrating in a manner that suspends the particles in an aerosol. The acoustic vibration of the alkaline particles also prevents agglomeration. Without particle fluidization, the highest stable concentration of submicron alkaline particles attainable in air is approximately 5 to 10 milligrams/cubic meter which requires very long paper exposure or particle impingement times. However, if a particle fluidization mechanism is utilized to keep the aerosol stable, the concentration of submicron alkaline particles can be increased to several kilograms/cubic meter without agglomeration When acoustic energy is used as a fluidization mechanism for the submicron alkaline particles, many of the problems associated with a high concentration of submicron particles, including their tendency to agglomerate, are overcome. At many frequencies and selected amplitudes (energies) of sound, it was found that a concentrated bed of alkaline particles can be made to simulate fluidization and can be agitated without excessive agglomeration. At certain frequencies and amplitudes, agglomerated alkaline particles will break apart and disperse. The alkaline particles respond to the acoustic energy by rapidly oscillating in the sonic field and impacting upon proximate surfaces. When the submicron alkaline particles impinge upon material being treated the particles may penetrate the paper structure. Agitation of the alkaline particles speeds the deacidification process because the moving alkaline particles more easily penetrate the air/solid boundary layer at the paper surface.

The present invention fluidizes submicron alkaline particles in a processing chamber with acoustic energy generated by ultrasonic transducers. The efficiency of agitation of the alkaline particles is affected by the output frequency of the acoustic transducers. Generally, lower frequencies agitate larger particles more efficiently, while higher frequencies agitate smaller submicron particles more efficiently. The ultrasonic frequency most suitable for fluidizing alkaline particles depends upon the nature and size of the alkaline particles.

If the alkaline particles vary significantly in size, single frequency ultrasonic energy may not effectively fluidize all particles in the chamber. A specific single acoustic frequency may efficiently fluidize small particles and not efficiently fluidize larger particles resulting in selective action. Particles of various sizes may be efficiently fluidized with multiple frequency acoustic energy. By knowing the range of particle sizes in the processing chamber, the frequencies of acoustic energy which efficiently fluidize all particles can be determined. A processing chamber may be configured with transducers producing various frequencies which efficiently fluidize all particles within the known size range.

The exposure of particles to multiple frequency acoustic energy may also reduce the agglomeration of the particles. As previously noted, submicron alkaline particles tend to agglomerate into clumps which may respond like larger particles when exposed to acoustic energy. Large clumps of agglomerated particles require a lower frequency to be agitated and may not be efficiently fluidized by the acoustic frequency that most efficiently agitates submicron particles. The agglomerated submicron particles may be broken apart by increasing the amplitude of the acoustic frequency which efficiently agitates the agglomerated particles. To both agitate submicron alkaline particles and break apart agglomerated particles, a processing chamber can be configured with low-frequency and high-frequency ultrasonic transducers. Because submicron particles may only be available as agglomerates larger than one micron in size, the present invention is preferably configured with acoustic transducers producing frequencies which efficiently agitate the submicron particles and break up larger agglomerations.

The inventive processing chamber is configured such that acoustic energy generated by ultrasonic transducers radiates from the surface of interior chamber wall(s). The acoustic energy of the processing chamber is affected by the geometry and construction of the chamber walls. The internal acoustic energy of the chamber may be enhanced by constructing the chamber with interior walls which reflect acoustic energy. Enhanced particle agitation may also be achieved by configuring opposing walls of the processing chamber with transducers emitting acoustic energy of different frequencies and amplitudes. Particle agitation may also be enhanced by configuring the wall opposite an acoustic energized wall to vibrate independently and act as a reflector.

FIG. 1 illustrates an embodiment of the present deacidification system. An oscillator 115 sends signals to an amplifier 107 which drives acoustic transducer(s) 109. Optionally an acoustic transducer or a fixed or free reflecting surface 111 may be configured on a wall opposite the acoustic transducer(s) 109. A bed of alkaline particles 119 is located between and agitated by the acoustic transducer(s) 109 and the acoustic transducer or a fixed or free reflecting surface 111. Sound absorbing walls 113 may be used to prevent acoustic energy from reflecting and may be positioned adjacent to the acoustic transducer 109 and the acoustic transducer or a fixed or free reflecting surface 111. The acoustic agitation of alkaline particles permits the concentration of particles in the bed of alkaline particles 119 to be very high while still being suspended in an aerosol. The treatment time are reduced because many more submicron particles impinge upon the materials being treated and the quantity of alkaline particles required to deacidify the materials are absorbed more quickly.

The spacing between the transducer walls and other chamber walls also affects the acoustic energy and may be adjusted or tuned to achieve the desired effects. In an embodiment of the present invention used to process single sheets of paper the spacing between chamber walls may be approximately 1.25–5.0 cm. In an embodiment of the present invention used to process bound books the spacing between chamber walls may be approximately 30.5–45.5 cm. In either treatment chamber configuration an additional transducer plate can be perpendicularly or otherwise mounted to other transducer walls to enhance the movement of alkaline particles.

The present invention is also suitable for treating very weak or brittle paper and books by using lower power multiple frequency acoustic energy. During processing of fragile materials, the acoustic energy is reduced to avoid damage resulting from highly agitated alkaline particles. Lower energy acoustical energy used during deacidification treatment vibrates the particles at relatively slow speeds to penetrate the fragile material paper structure. By reducing the acoustic energy in this manner, even weak or embrittled paper can be treated without harm to the material.

When the present invention is used in low acoustic amplitude mode to treat fragile materials the particle agitation may be insufficient to prevent agglomeration. To increase the submicron alkaline particle concentration during processing, the acoustic field can be controlled to generate higher amplitude acoustic energy to break up agglomerates just prior to material treatment while the processing chamber is empty of materials to be treated.

The alkaline materials exist as a bed of powder within the processing chamber and can comprise any suitable basic metal oxide, hydroxide or salt. Suitable materials include: oxides, hydroxides, carbonates and bicarbonates of the Group 1 and 2 metals of the Periodic Table, as well as zinc. In the preferred embodiment, the cation of the alkaline material is magnesium, zinc, sodium, potassium, or calcium. Also preferred are alkaline materials that are relatively non-toxic including: oxides, carbonates and bicarbonates of magnesium and zinc and the hydroxides of sodium, potassium and calcium. Mixtures of alkaline particle materials may also be suitable. Examples of the preferred alkaline materials include magnesium oxide, magnesium carbonate, magnesium bicarbonate, zinc carbonate, zinc bicarbonate, zinc oxide, sodium hydroxide, potassium hydroxide and calcium hydroxide. The most preferred alkaline material for the inventive deacidification process is magnesium oxide.

In an embodiment of the present invention the processing chamber may be configured to most efficiently agitate the preferred alkaline particles between 0.01 and 0.9 microns in size. Thus, particles between 0.01 and 0.9 micron in size may comprise 95–99% of the agitated particles during the actual treatment. The preferred average alkaline particle size is between approximately 0.1 and 0.6 micron and most preferably about 0.3 micron in size.

Typical alkaline particle surface areas are between 100 and 200 $m^2/g$ BET preferably about 150 $m^2/g$. It is preferable to treat with alkaline particles having high reactivity which enhances the adhesion of alkaline particles to the paper surfaces. Highly reactive materials also allow the alkaline particles to quickly hydrate or react with water to form hydroxides and basic carbonates.

In another embodiment of the present invention, the alkaline particles are preferably formed by calcination (preferably flash calcinization) of the elemental salts. For example, basic magnesium carbonate is calcined at a temperature between 400 degree C. and 700 degree C. by any known process. These temperatures produce a polydisperse of high activity magnesium oxide agglomerates made up of smaller particles with an average particle size of 0.3 microns and a predominant particle size between 0.1 and 0.9 micron. It was found that size, reactivity and chemical composition affect deagglomeration and dispersion of the alkaline particles in a suitable gas medium such as air when used in a fluidized bed exposed to an acoustical field. Particles in the submicron range are shown to both penetrate and coat the paper without obstructing images or print. The treated paper preferably has sufficient surface reactivity to firmly hold the alkaline particles and withstand normal handling without dusting.

As discussed the use of the proper acoustic energy frequencies not only agitates the particles, but also deagglomerates existing particle bundles. Varying the frequencies or using multiple acoustic transducers at different frequencies assures that a full range of particle agglomerates are dispersed and broken up. The acoustic energy method of deagglomeration can be augmented with a recirculation mechanism that continuously draws from the particle bed and passes the alkaline particles through an air impingement or sonic devices (sonilators) to further assist in breaking up or dispersing agglomerates. This recirculation method can also provide a directed flow of gas and/or alkaline particles to open and separate the pages of a book to allow deacidification of the individual pages.

Although recirculation is a means of directing alkaline particles, the main mechanism of particle deposition onto the paper being deacidified is acoustic agitation of the particles in the concentrated bed. A further advantage of using sonic agitation is that the impact of alkaline particles against other particles abrades the particle surfaces and tends to remove any accumulated surface salts (e.g., hydroxides and carbonates). Abraded particle surfaces have an increased number of available reactive sites, increasing the reactivity of the particles, i.e. the "adhesiveness" of the particles to the paper fibers.

In one embodiment, the particle bed may first be exposed to lower frequency acoustic energy which breaks up agglomerated particles, then during material deacidification processing, the acoustic energy and frequency are adjusted to optimize particle reactivity with the material being treated. The deacidification acoustic energy amplitude during material processing is kept below that used to deagglomerate the alkaline particles before material processing. The acoustic frequencies which agitate submicron particles during material deacidification range from approximately 1 kHz to 1 MHz and is preferably between 15 KHz and 500 KHz. The amplitude of acoustic agitation energy may preferably be regulated to impart alkaline particle velocities ranging from approximately $1\times10^{-1}$ to $1\times10^{-4}$ m/sec. Suitable frequencies and energies for particle agitation are affected by the concentration of particles, treating chamber geometry, transducer size, the number of transducers, reflecting or focusing devices within the chamber and the nature of the articles to be treated.

Deagglomerate normally takes place at atmospheric pressure. Enhanced deagglomeration of alkaline particles may be obtained by pressurizing the deacidification processing chamber slightly. A 3.45 Mpa (0.5 p.s.i.) increase in processing chamber pressure improves deagglomeration and results in approximately double the number of alkaline particles less than 0.5 micron in size.

In an embodiment of the present invention, ultrasonic transducers producing a mixture of frequencies are arranged in the processing chamber such that at least one of the transducers on each wall emits at least one different output frequency from the other transducers. The mixing of transducer frequencies minimizes the generation of standing waves. In another embodiment each transducer on a common wall emits different output frequencies.

Further improvements in performance are possible by agitating the alkaline particles with a variable acoustic energy that matches the size of the alkaline particles during processing. When the alkaline particles are first exposed to acoustic energy the large number of agglomerated clumps of particles are most efficiently agitated with lower frequency acoustic energy. As deagglomeration occurs, the clumps of particles are broken up and a higher percentage of smaller sized particles exist in the alkaline particle bed which vibrate more efficiently in response to higher frequency acoustic energy. The transducers may be configured to begin particle agitation at a low frequency then shift to higher frequencies as the particle agglomerations are broken up.

In an embodiment of the present invention, the alkaline particle bed may be configured with increasing frequency output from transducers in the direction of material flow. The transducers near to the entrance of the material may have a low frequency. The frequency of subsequent transducers may be increased progressively until the highest frequency is coming from the row of transducers near to the exit of the enclosure.

In an embodiment of the present deacidification invention, materials such as papers or books are placed within a processing chamber and are suspended during processing in a bed of ultrasonically agitated submicron alkaline particles. The preferred concentration of submicron alkaline particles is between approximately 50 to 1,000 grams/cubic meter or higher. The inventive system is also capable of batch treatment of large numbers of papers or books.

In a sequential processing embodiment of the present invention, higher frequency acoustic energy is applied as the alkaline particles become finer. In a system particularly suitable for continuous operation two or more cells or enclosures may be connected in series wherein each successive cell is equipped with transducers producing increasingly higher frequency output. For example, particles in a first cell may be agitated with a low transducer output frequency, a second cell may agitate particles with a higher transducer frequency and subsequent cells may have progressively higher transducer output frequencies. The ultrasonic transducers may increase in output frequencies from 5 KHz up to 5 MHz. In other embodiments of the present invention, materials are continuously deacidified by passing them through an alkaline bed by a conveyor system such as automatic feeding systems common to printers or other document handlers. Uniformity of the deacidification treatment of materials is maintained by controlling the concentration of particles, the time of exposure of the article in the fluidized alkaline particle bed as well as the frequency and amplitude of the ultrasonic transducers.

The inventive deacidification system may also be configured with both parallel and sequential processing chambers. Specifically, if processing at high frequency takes less time than processing at lower frequency, two or more lower frequency chambers may feed into a single higher frequency chamber, making the deacidification system more efficient. In an alternative configuration, one low frequency chamber may feed into two or more higher frequency chambers.

In a single sheet treating embodiment of the present invention, paper is fed through the ultrasonically agitated bed of submicron alkaline particles by an arrangement of feeding rollers. In this embodiment, the paper passes through an area where the transducer and reflector are an inch or less apart. Only the bed of particles between the sonic plates is required to be activated or fluidized by ultrasonic agitation which makes the system energy efficient.

Figure 2:
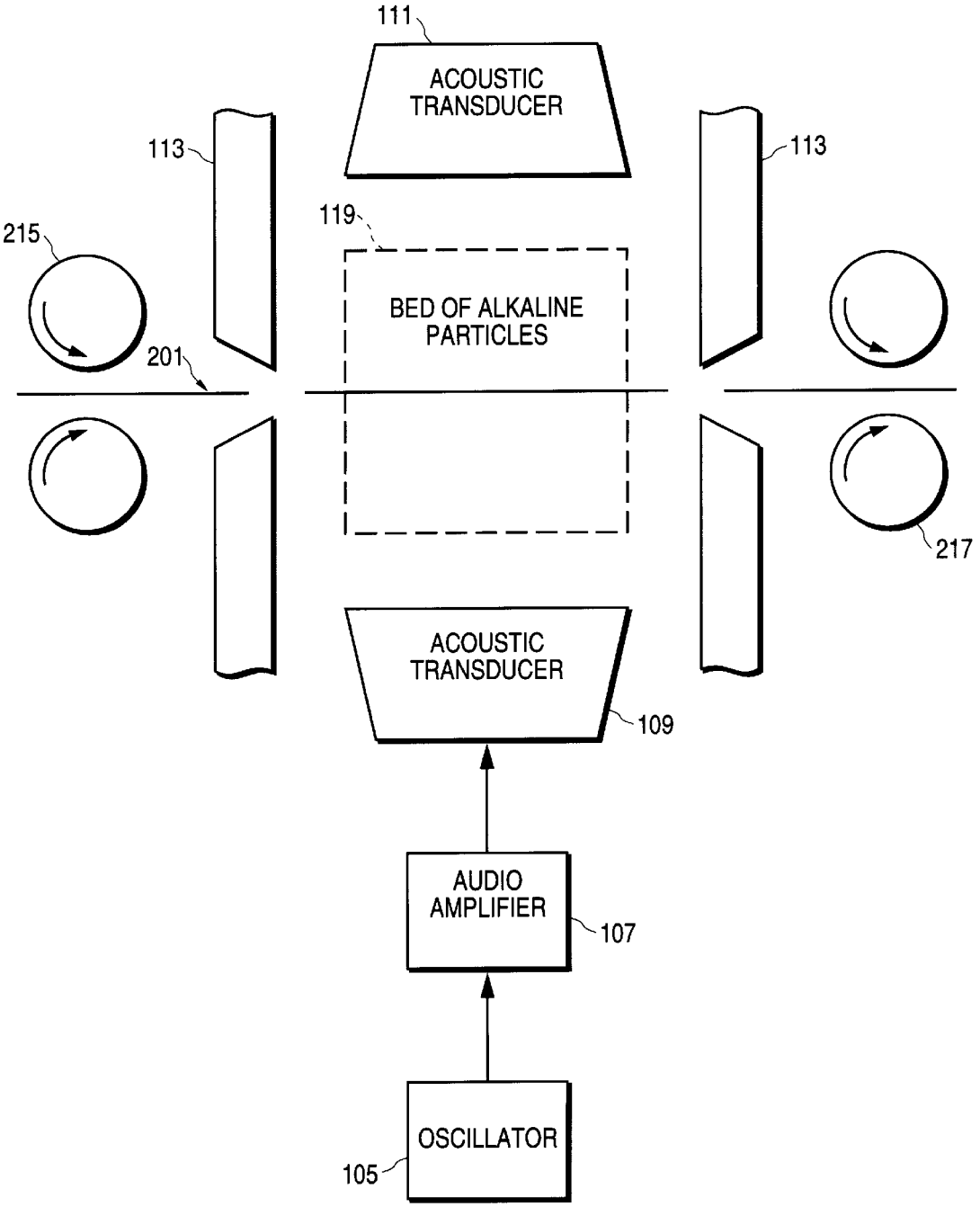
FIG. 2 illustrates a deacidification apparatus of the present invention configured to treat flat materials.

FIG. 2 illustrates an embodiment of the present deacidification system combined with a sheet transportation mechanism. The deacidification mechanism is similar to that described with reference to FIG. 1. The paper transportation system allows high capacity continuous deacidification processing by inputting paper through sheet feed rollers 315 which delivers paper to the bed of alkaline particles 119 and sheet exit rollers 317 which remove the processed paper. The sheet feed deacidification system can be made relatively compact and can easily be adapted to an in-house treatment.

As materials are processed, the alkaline particles are consumed by the treated materials and the particle baths require periodic refilling. In an embodiment of the present invention, submicron alkaline particle powder are stored within a storage container and fed to the treatment chamber as needed. The particles are transferred from the storage container to the treatment chamber by gravity, pressure, re-circulation mechanism or other suitable transfer mechanisms. The storage container may hold enough powder to deacidify approximately 3–4 thousand sheets of paper. When the inventive deacidification system consumes all of the alkaline particles, the storage container is replaced like a replaceable toner cartridge in a copy machine. Because the alkaline particles are sealed within the treatment chamber unit and protected from exposure to the atmosphere, highly reactive materials such as magnesium oxide may be used. It is necessary to isolate highly reactive particles from the environment because they react with atmospheric water and carbon dioxide.

Figure 3:
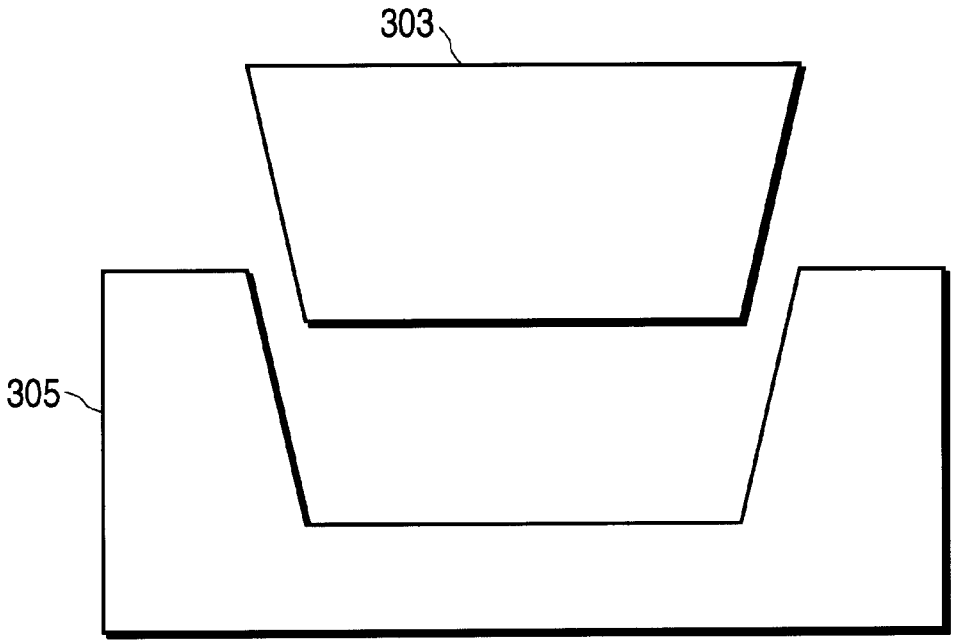
FIG. 3 illustrates a deacidification apparatus of the present invention configured with a replaceable receptacle or cartridge.

FIG. 3 illustrates an embodiment of the present invention which allows the deacidification unit housing 305 to be refilled with a replaceable cartridge 303 of alkaline particles without having to handle the raw submicron alkaline particles. The replaceable cartridge 303 contains a reserve of alkaline particles and may include seals to prevent the escape of the alkaline particles and a feed mechanism that delivers the alkaline particles to the deacidification processing chamber.

Figure 4:
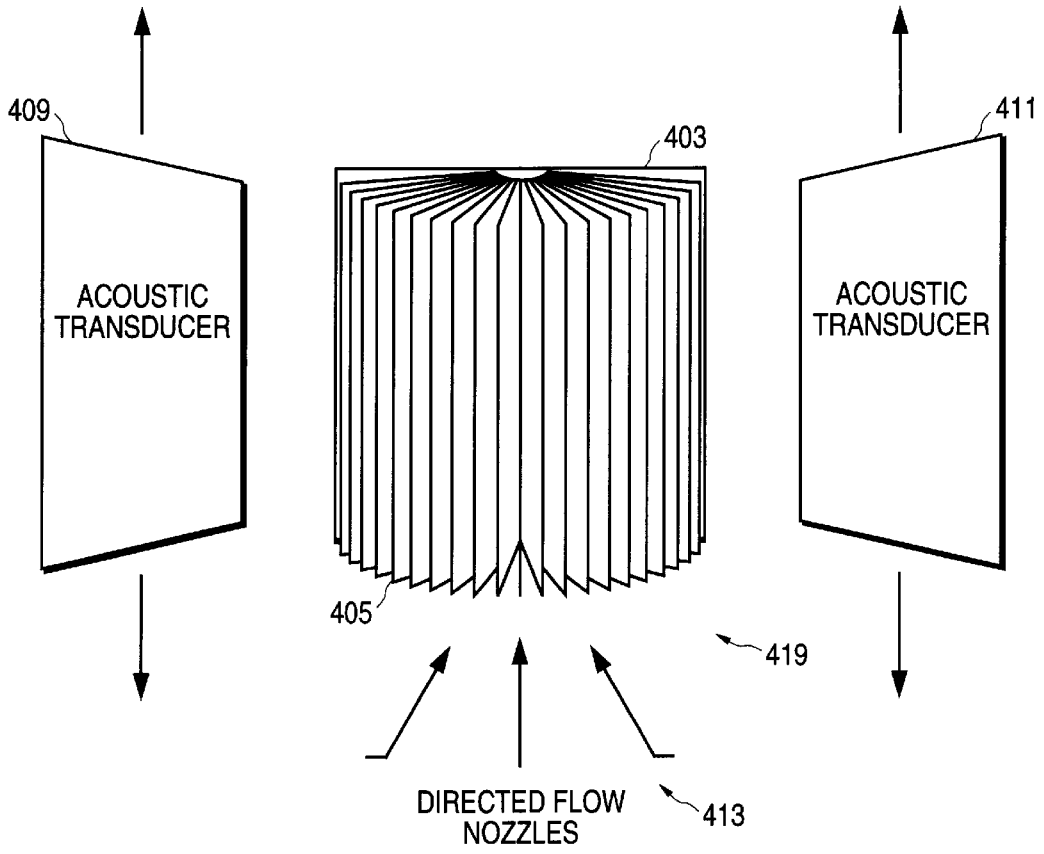
FIG. 4 illustrates a deacidification apparatus of the present invention configured to treat bound materials; and, FIG. 5 illustrates a deacidification apparatus of the present invention configured as a small add-on unit located at the sheet exit of a printer or copier.

FIG. 4 illustrates an embodiment of the present invention capable of treating bound manuscripts or books. Bound materials 403 are placed in a bed of alkaline particles 419 in the deacidification processing chamber 401. The bound materials 403 are placed in an open position exposing the individual pages 405 to alkaline particles which are fluidized by acoustic transducers 409 and 411. Flow nozzles 413 direct pressurized gas and optionally alkaline particles at pages 405 of the bound materials 403 in a manner that allows each page 405 to be exposed to alkaline particles. After all pages 405 have been deacidified, the bound materials 403 may be removed from the processing chamber 401.

Figure 5:
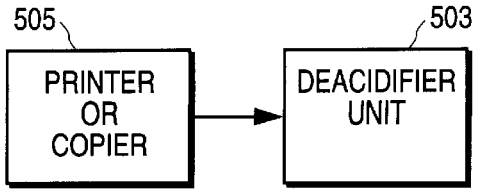

FIG. 5 illustrates the use of the inventive deacidification unit 503 in conjunction with a printer or copier 505. The deacidification unit 503 is placed at the outlet of the printer or copier 505 so that when sheets of materials exit the printer or copier 505 they are fed directly into the deacidification unit 503. The combination of the printer or copier 505 produce materials that will not break down over time due to acid attacks. The printer or copier 505 may be configured with an internal deacidification unit 503 or the deacidification unit 503 may be externally connected to the printer or copier 505.

Table 1 and 2 illustrate the change in pH of materials before and after being treated by the inventive deacidification process. As is known in the art, pH is a measure of acidity/alkalinity of a solution. A pH of 7 represents a neutral material, lower numbers indicate increasing acidity and higher numbers increasing alkalinity. Each unit of change represents a tenfold change in acidity or alkalinity. Note that after treatment the pH level rises significantly indicating that the materials are more alkaline.

TABLE 1

Impregnation of Single Sheets with Submicron Magnesium Oxide

| Paper | pH Before Treatment | pH After Treatment | % Magnesium Oxide* |
|---|---|---|---|
| Newsprint | 4.5 | 8.3 | 1.3 |
| Cold Offset | 5.5 | 9.0 | 1.4 |
| Whatman Filter Paper No. 1 | 5.5 | 9.2 | 1.5 |
| Ledger Paper | 4.8 | 8.9 | 1.1 |
| Old Book Paper 1945 | 4.3 | 8.2 | 1.3 |
| Bond | 5.8 | 9.4 | 1.4 |

TABLE 2

Impregnation of Bound Book Papers with Submicron Magnesium Oxide

| Paper | pH Before Treatment | pH After Treatment | % Magnesium Oxide* |
|---|---|---|---|
| Title 1 - date | 4.5 | 8.7 | 1.3 |
| Title 2 - date | 4.8 | 9.0 | 1.2 |
| Title 3 - date | 4.3 | 8.4 | 1.4 |

*Note: After treatment, deposited magnesium oxide reacts naturally with water in the paper or water vapor and carbon dioxide in ambient air to form magnesium hydroxide and basic magnesium carbonate which provide an alkaline reserve for future deacidification of the paper.

After deacidification processing the treated materials may require additional treatment to be suitable for handling. The treated paper may be gently vacuumed and/or cleaned with a combination of pressurized gas and mild vacuum to remove any loosely held any aggregates or excess alkaline particles. Other post treatment processing may include exposing the treated materials to humid air which sets the particles more firmly into the paper by beginning the conversion of the alkaline oxide to the hydroxide and basic carbonate.

In all alkaline particle transfer deacidification processes, alkaline particles are suspended within the processing chamber atmosphere and impinge upon the material. In liquid systems the alkaline particles must travel through a solid-liquid interface and in gas systems the particles travel through a solid-gas interface. The present invention distributes particles through a solid-gas (paper-particles suspended in gas) interface during treatment rather than a solid-liquid interface. The boundary layers of a solid-gas interface are known to be much thinner than those of a solid-liquid interface, thus systems having solid-gas interfaces are able to transfer alkaline particles to the material being treated more easily.

There are several other advantages of gas suspended particles over liquid suspended particles. The gas suspended particles are able to more uniformly treat object having complex geometric features like bound manuscripts or books because they are more easily circulated into the confined spaces such as found near the spine of books where the pages are bound. The impact velocities of gas suspended particles are much higher than liquid suspended particles allowing better penetration of the materials being deacidified. The adhesion of gas suspended alkaline particles to the materials being treated is also much faster in a gas treatment system than a liquid system.

A deacidification system for treating sheets of paper and bound materials has been described. Although the present invention has been described with reference to specific exemplary embodiments, it will be evident that various modifications and changes may be made to these embodiments without departing from the broader spirit and scope of the invention as set forth in the claims. Accordingly, the specification and drawings are to be regarded in an illustrative rather than a restrictive sense.

What is claimed is:

1. A method of deacidifying lignocellulosic materials comprising the steps of: fluidizing a dry bed of alkaline particles with acoustic energy; immersing the lignocellulosic materials into the dry bed of alkaline particles; and deacidifying the lignocellulosic materials.

2. The method of claim 1, wherein the dry bed of alkaline particles are substantially submicron in size and in a deagglomerated state.

3. The method of claim 1, wherein the alkaline particles are particles selected from the group consisting of: oxides, hydroxides, and carbonates.

4. The method of claim 1, wherein the acoustic energy is produced by a transducer.

5. The method of claim 1, further comprising the step of: deagglomerating and dispersing the alkaline particles.

6. The method of claim 1, wherein the dry bed of alkaline particles are salts of basic metals.

7. A process for deacidification of flat sheets of lignocellulosic materials, comprising the steps of:

fluidizing a bed of alkaline particles by agitating dry alkaline particles with acoustic energy;

passing the flat sheets of lignocellulosic materials through the dry bed of alkaline particles; and deacidifying the flat sheets of lignocellulosic materials.

8. The method of claim 7, wherein the dry alkaline particles are substantially submicron in size.

9. The method of claim 7, wherein the flat sheet of lignocellulosic materials are passed through the dry bed of alkaline particles with a sheet feed mechanism.

10. The method of claim 7, wherein the alkaline particles are particles selected from the group consisting of: oxides, hydroxides, and carbonates.

11. The method of claim 7, wherein the acoustic energy is produced by an ultrasonic transducer.

12. The method of claim 7, further comprising the step of:

deagglomerating and dispersing the dry alkaline particles.

13. The method of claim 7, further comprising the step of:

binding the dry alkaline particles to the lignocellulosic materials.

14. A process for deacidification of a bound book, comprising the steps of: fluidizing a dry bed of alkaline particles with acoustic energy; immersing a bound book in the dry bed of alkaline particles; and deacidifying the bound book.

15. The method of claim 14 wherein the bound book is held in the dry bed of alkaline particles while an acoustic transducer moves across pages of the book in a reciprocal manner.

16. The method of claim 14 further comprising the step of:

opening pages of the book with gas jets.

17. The process according to claim 16, further comprising the step of:

re-circulating the dry alkaline particles from the dry bed of alkaline particles through a re-circulation system, which feeds the dry alkaline particles to the gas jets.

18. The process according to claim 17, further comprising the step of:

dispersing and deagglomerating the dry alkaline particles with sonilators.

19. The method of claim 14, wherein the acoustic energy is of a frequency that enhances the dispersal and deagglomeration of the dry alkaline particles.

* * * * *